United States Patent [19]

Karol

[11] Patent Number: 4,521,318

[45] Date of Patent: Jun. 4, 1985

[54] LUBRICANT COMPOSITIONS CONTAINING BOTH HYDROCARBYL SUBSTITUTED MONO AND BISSUCCINIMIDE HAVING POLYAMINE CHAIN LINKED HYDROXACYL RADICALS, AND NEOPENTYL DERIVATIVE

[75] Inventor: Thomas J. Karol, Wappingers Falls, N.Y.

[73] Assignee: Texaco Inc., White Plains, N.Y.

[21] Appl. No.: 551,543

[22] Filed: Nov. 14, 1983

[51] Int. Cl.[3] ..... C10M 1/48; C10M 3/42

[52] U.S. Cl. ..... 252/46.7; 252/51.5 A

[58] Field of Search ..... 252/51.5 A, 46.7

[56] References Cited

U.S. PATENT DOCUMENTS 3,219,666 11/1965 Norman ..... 252/51.5 A 3,281,359 10/1966 Oherender ..... 252/48.6

*Primary Examiner*—John F. Niebling

*Attorney, Agent, or Firm*—Robert A. Kulason; James F. Young; James J. O'Loughlin

[57] ABSTRACT

A lubricant composition comprising a major amount of a lubricating oil and an effective dispersant amount of both a hydrocarbyl-substituted mono- and bis-succinimide having polyamine chain linked hydroxyacyl radicals, and a polyol derivative prepared by contacting an aliphatic polyolefin with $P_2S_5$ in the presence of sulfur and $P_2S_5$, contacting the resultant polyolefin-$P_2S_5$ reaction product with a steam, removing inorganic phosphorus acid from the steam treated polyolefin $P_2S_5$ reaction product, and contacting the polyolefin $P_2S_5$ reaction product with a neopentyl polyol. The combination of succinimide and polyol derivative exhibit enhanced dispercancy and/or detergency over either additive alone.

13 Claims, No Drawings

LUBRICANT COMPOSITIONS CONTAINING BOTH HYDROCARBYL SUBSTITUTED MONO AND BISSUCCINIMIDE HAVING POLYAMINE CHAIN LINKED HYDROXACYL RADICALS, AND NEOPENTYL DERIVATIVE

BACKGROUND OF THE INVENTION

This invention relates to lubricant compositions, and more particularly to lubricant compositions containing a synergistic mixture of a hydrocarbyl-substituted mono and bis succinimide having polyamine chain linked hydroxacyl radicals and a neopentyl polyol derivative as a detergent and/or dispersant.

Internal combustion engines operate under a wide range of temperatures including low temperature, stop and go service as well as high temperature conditions produced by continuous high speed driving. Stop-and-go driving, particularly during cold, damp weather conditions, leads to the formation of a sludge in the crankcase and in the oil passages of a gasoline or a diesel engine. This sludge seriously limits the ability of the crankcase oil to lubricate the engine. In addition, the sludge with its enrapped water tends to contribute to rust formation in the engine. The noted problems tend to be compounded by standard lubrication service recommendations for extended oil drain intervals. With the introduction of four cylinder internal combustion engines which must operate at high speeds to produce the required torque output, it has become increasingly difficult to provide a satisfactory dispersant lubricating oil composition.

The high temperature operating conditions increase the oil's propensity for oxidation. Oxidized oil thickens when cooled and will not afford satisfactory lubrication. Certain mineral oil based stocks are more prone to oxidation than others. The base stocks used in many European lubricating oils have been found to have a higher propensity for oxidation than base stocks used in the United States. Further, lubricant compositions need to be compatible with the elastomer seals used in internal combustion engines, such as Viton seals. Many oil additives have been found to be aggressive towards the seals causing their deterioration.

Previously, nitrogen containing compounds which act as dispersants and/or detergents have been used in the formulation of lubricant compositions. Many of these dispersant and/or detergent compounds are based on the reaction of an alkenylsuccinic acid anhydride with amine or polyamine to produce an alkylsuccinimide or an alkylsuccinic acid as determined by the conditions of reaction. Such products contain a high level of nitrogen in order to provide improve dispersency in a crank case lubricant composition. One such class of compounds which are excellent dispersants and/or detergents is set forth in coassigned U.S. Pat. No. 4,482,464, whose disclosure is incorporated herein by reference.

Other useful detergent and/or dispersant additives for a lubricant composition are based on derivatives of neopentyl polyols and polyolefinic-$P_2S_5$ products. A preferred class of such compounds are set forth coassigned U.S. Pat. No. 3,281,359 whose disclosure is incorporated herein by reference. However, it is been found that with many lubricating oils particularly those containing European base stocks neither of these two class of detergents and/or dispersants have been found to be entirely satisfactory under all operating conditions.

SUMMARY OF THE INVENTION

It is now been found that an additive mixture comprising a hydrocarbyl substituted mono and bis-succinimide having polyamine chain linked hydroxyacyl radical such as set forth in coassigned U.S. Pat. No. 4,482,464, and a derivative of neopentyl polyols and polyolefinic-$P_2S_5$ products as set forth in coassigned U.S. Pat. No. 3,281,359 produces a synergistic effect in a lubricant composition. It has been found that the detergency and/or dispersency of such a combination of additives in a lubricant composition is superior to the dispersency and/or detergency of either of these two compounds alone. The invention also includes a concentrate having this mixture of additives for dilution with lubricating oil to form a lubricant composition.

PREFERRED EMBODIMENTS OF THE INVENTION

A preferred embodiment of the present invention is a lubricant composition comprising a major amount of an oil of lubricanting quality and an effective dispersant amount of the two additives. Alternatively, the present invention comprises a concentrate comprising a major amount of the two additives of the present invention and a minor amount of a lubricating oil or other dilutent. Other additives can also be present in the lubricant composition or concentrate. Further the present invention includes a process of increasing the detergency and/or dispersency of a lubricating oil to form a lubricant composition by adding the two additives of the present invention thereto.

The hydrocarbyl-substituted mono- and bis-succinimide having polyamine chain linked hydroxyacyl radicals of the invention which include the preferred N-hydroxacylated polyamine succinimides are represented by the formula:

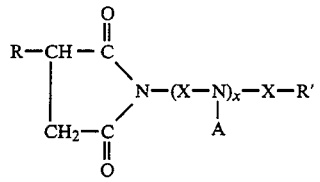

in which R is a hydrocarbyl radical having from about 8 to 400 carbon atoms, and preferably an alkyl radical having from about 50 to 200 carbon atoms, X is a divalent alkylene or secondary hydroxy-substituted alkylene radical having from 2 to 3 carbon atoms, A is hydrogen or a hydroxyacyl radical from the group consisting of glycolyl, lactyl, 2-hydroxymethyl propionyl and 2,2'-bis-hydroxymethyl propionyl radicals and in which at least 30 percent of said radicals represented by A are said hydroxyacyl radicals, x is a number from 1 to 6, preferably from 2 to 4, and R' is a radical selected from the group consisting of $NH_2$, —NHA or a hydrocarbyl substituted succinyl radical having the formula:

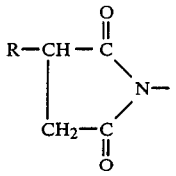

in which R has the value noted above.

It is essential that at least thirty percent of the reactive nitrogen atoms in the succinimide chain form an amine with the prescribed hydroxyacyl radical in order to provide a dispersant which inhibits the deterioration of elastomer or Viton engine seals. It is preferred that at least fifty percent, i.e. from 50 to 100 percent, of the reactive nitrogen atoms be reacted with a hydroxy aliphatic acid to form the amide. The most preferred compounds are those in which substantially all of the reactive nitrogens in the succinimide chain have been reacted such as from about 85 to 100%, to form the prescribed amides.

Particularly effective hydroxyacylated hydrocarbyl-substituted monosuccinimides are those prepared from an alkenylsuccinimide and glycolic acid. This hydroxyacylated monosuccinimide is represented by the formula:

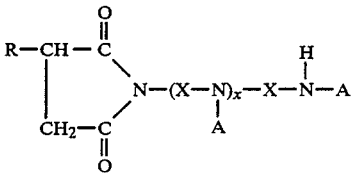

in which R is a monovalent alkenyl radical having from about 50 to 200 carbon atoms, preferably 80 to 150 carbon atoms, X is a divalent alkylene radical having from 2 to 3 carbon atoms, x is a number from 1 to 6 and preferably from 2 to 4, and A is a radical in which from 85 to 100 percent of said reactive nitrogen atoms have been reacted to form amides with the noted glycolyl radicals.

A preferred bis-hydrocarbylsuccinimide of the invention is represented by the formula:

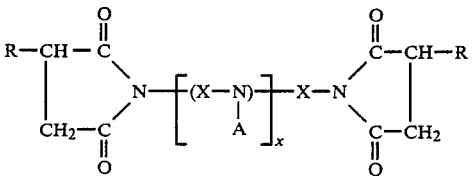

in which R, X, x, and A have the values noted above.

The hydrocarbyl-substituted mono- and bis-succinimide having polyamine chain linked or pendant hydroxyacyl radicals of the invention is prepared by reacting a hydrocarbylsuccinimide or hydrocarbyl-substituted bis-succinimide with the prescribed hydroxyaliphatic acid and effecting a reaction under acylating conditions. The amount of hydroxyacylating agent employed is an amount necessary to react with at least thirty percent of the reactive nitrogen atoms in the succinimide chain. Preferably, the amount of hydroxacylating agent employed will be an amount which can react with from 50 and 100 percent of the reactive nitrogen atoms in the succinimide chain to effect the formation of amides. Amounts of hydroxyacylating agent approximately stoichiometrically equivalent in moles to the amount of reactive nitrogen atoms present in the succinimide chain or excess amounts of said agent are suitable. The hydroxyacylating agent and the reactive nitrogen moieties in the succinimide are reacted until the prescribed amount of amidation has taken place. Hydrocarbyl-substituted mono- and bis-succinimides are well known in the art and their preparation does not constitute a part of this invention.

The compounds which can be employed for preparing the prescribed succinimide of the invention are hydroxy aliphatic acids from the class consisting of glycolic acid, lactic acid, 2-hydroxymethyl propionic acid and 2,2'-bis-hydroxymethyl propionic acid. It is understood that equivalents of the aliphatic acids prescribed namely their anhydrides and acyl halides can also be employed in the practice of this invention. A characteristic of the prescribed $C_2$ and $C_3$ hydroxyaliphatic carboxylic acids is their relatively limited or negligible solubility in mineral oil.

Presently the most preferred substituted succinimide is a N-hydroxyacylated polyamine succinimide made by reacting one mole of alkylsuccinic acid anhydride with between about 0.5 and 1.0, mole of tetraethylpentamine (TEPA) and then with between about 1.0 and 4.0 mole of glycolic acid. The TEPA is made by reacting ammonia and dichloroethylene, and distilling the desired polyamine from the reaction product. The precise procedure is set forth above and in coassigned U.S. Pat. No. 4,482,464.

A second useful N-hydroxyacylated polyamine succinimide is made by reacting one mole of alkyl succinic acid anhydride with between about 0.5 and 1.0 mole of pentaethylenehexamine (PEHA) and then with between about 1.2 and 5.0 mole of glycolic acid. The PEHA is made by reacting ammonia and dichloroethylene and then distilling the desired polyamine from the reaction product.

The prescribed succinimide of the invention is generally employed at a concentration, in which succinimides comprise as the percent by weight of nitrogen contributed by the succinimide, ranging from about 0.01 to 0.5 weight percent nitrogen. Broader concentrations from about 1 to 80 weight percent can also be employed in a concentrate which is diluted with lubricant base to form a lubricant composition.

The second dispersant-detergent additive of the synergistic mixture of present invention is a derivative of neopentyl polyols, and the inorganic, phosphorus acid free, hydrolyzed reaction products of a polyoefin and $P_2S_5$. The derivatives of neopentyl polyols which are useful in the lubricant composition of the present invention can be prepared as follows.

A polyolefin-$P_2S_5$ reaction product is first prepared. The polyolefinic hydrocarbon reactant usually contains at least 12 carbon atoms although lower molecular weight olefins can be employed. Aliphatic hydrocarbon monolefinic polymers such as polyethylene, polypropylene, polyisopropylene, polyisobutylene, polybutene, and copolymers of monoolefins such as propylene-isobutylene copolymers are examples of the monoolefinic polymers contemplated herein. In general, monoolefinic polymers and copolymers having an average molecular weight of between about 250 and 50,000 are employed with polymers and copolymers having an average molecular weight in the range from 600 to 5,000 being particularly preferred. Copolymers of conjugated dienes and monoolefins such a copolymer of butadiene and isobutylene having an average molecular weight in the above prescribed ranges are also contemplated. Particularly preferred olefin polymers are the monoolefinic polyisobutylene polymers having an average molecular weight between 600 and 5,000.

The polyolefin is reacted with $P_2S_5$ (about 5–40 wt. percent of the reaction mass) at a temperature from about 100 to about 320° C. in the presence of between about 0.1 and 5.0 wt. percent sulfur. This reaction is normally conducted for a period of between about 1 and 10 hours. The reaction mixture is not in a liquid state is placed in a liquid state under preferred conditions. The liquefaction is accomplished by diluting the reaction mixture with a mineral lubricating oil having an SUS viscosity at 100° F. between about 50 and 1000. The lubricating oil usually constitutes between about 25 and 75 wt. percent of the diluted reaction product concentrate.

The mineral oil diluted or undiluted polyolefinic-$P_2S_5$ reaction product is then hydrolyzed by contracting with steam at a temperature desirably between about 100° and 260° C. Under advantageous conditions, at least about one mole of steam is employed per mole of reaction product and the hydrolysis is conducted for a period of 1 to 20 hours. Inorganic phosphorus acids are formed during the hydrolysis, and they are removed by standard procedure. A number of different procedures are available for removal of the inorganic phosphorus acids. In U.S. Pat. Nos. 2,951,835 and 2,987,512 removal of the inorganic phosphorus acid is effected by contact with synthetic anhydrous alkaline earth metal silicates and synthetic anhydrous alkali metal silicates, respectively. Commonly assigned U.S. Pat. No. 3,135,729 also describes a process where inorganic phosphorus acids are removed from the hydrolyzed product.

The inorganic phosphorus acid free, hydrolyzed polyolefin-$P_2S_5$ reaction product is then contacted with a neopentyl polyol of the formula:

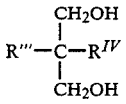

where R''' and $R^{IV}$ are members selected from the group consisting of alkyl and alkylol of from 1 to 20 carbon atoms at a temperature between about 180° to 220° C. in a mole ratio of neopentyl polyol to hydrolyzed reaction product of between about 0.33:1 and 2:1. This reaction is normally conducted for a period of 1 to 10 hours. The resulting product is believed to be primarily a complex mixture of hydrocarbon phosphorus acid monoesters, diesters, polysters, cyclicesters and anhydrides.

Under preferred conditions, the esterification reaction is continued until the total acid number (TAN) of the reaction mixture falls below about 5. To obtain this TAN level normally the removal of between about 1.0 to 1.4 moles of water by-product per mole of hydrolyzed $P_2S_5$-polyolefin reaction product is required. A method of determining TAN values is described in ASTM test D664-54.

Specific examples of the neopentyl polyol reactants contemplated herein are pentaerythritol, trimethylolpropane, trimethylolethane, trimethylolbutane and neopentylglycol 2-methyl-2-ethyl-1,3-propanediol, 2,2-didecyl-1,3-propanediol and 5,5-dimethylolhexanol.

Presently the most preferred dispersant and/or detergent of this type is made from polyisobutane having a molecular weight of between about 1,000 and 1,500, with between about 1,000 and 1,300 being most preferred, represented as PIB below. The polyisobutane is reacted with phosporus pentasulfide ($P_2S_5$),

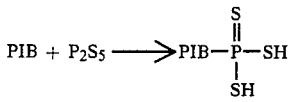

This intermediate is reacted with pentaerythritol to form the desired alkylthiophosphenate ester of pentaerytheritol, here the polyisobutene-thiophosphenate ester.

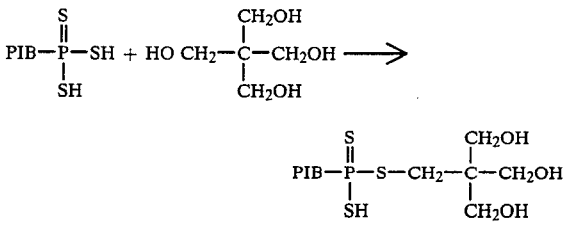

A preferred method of preparing a detergent and/or dispersant polyol derivative comprises, contacting an aliphatic polyolefin of an average molecular weight between about 250 and 50,000 with $P_2S_5$ in the presence of between about 0.1 and 5 wt. percent sulfur at a temperature of between about 100° and 320° C., $P_2S_5$ comprising between about 5 and 40 wt. percent of the reaction mixture and contacting the resultant polyolefin-$P_2S_5$ reaction product with steam at a temperature between about 100° and 260° C. utilizing at least about a mole ratio excess of steam in respect to the polyolefin-$P_2S_5$ reaction product. The inorganic phosphorus acid is removed from the steam heated polyolefin $P_2S_5$ reaction product and the inorganic acid free, steam hydrolyzed polyolefin $P_2S_5$ reaction product is contacted with a neopentyl polyol of the formula:

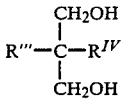

where R''' and $R^{IV}$ are selected from the group consisting of alkylol and alkyl of from 1 to 20 carbon atoms at a temperature between about 180° and 220° C. in a mole ratio of the inorganic phosphorus acid free, steam hydrolyzed $P_2S_5$ polyolefin reaction product to the polyol of between about 1:0.33 and 1:2 to form the polyol derivative.

The polyolefin-$P_2S_5$ derivatives of neopentyl polyol used in the lubricant composition of the present invention preferably comprise from about 0.05 to about 10 weight percent of the finished lubricant composition. These derivatives can also comprise to about 10 to about 80 percent by weight of a concentrate which is subsequently diluted to form the desired lubricant composition.

The quantity of succinimide, represented as the percent by weight of nitrogen contributed by the succinimide, is preferably from about 0.05 to about 0.1 weight percent nitrogen used in conjunction with from about 0.05 to 10% by weight of the derivative of polyol. More preferably the succinimide is used in an amount from about 0.06 to about 0.07 weight percent nitrogen used in conjunction with from about 1 to about 3% by weight of the derivative of polyol.

The lubricant composition or concentrate containing the synergistic combination of detergent and/or dispersant additives of the invention can contain other additives designed to impart other desirable properties to the lubricant composition. For example, the lubricant composition can also comprise viscosity improvers, such as polymethacrylates, antioxidents, antifoamants, and corrosion inhibitors.

The major portion of the lubricant composition can comprise a hydrocarbon mineral oil. Such an oil can be a paraffin base, a naphthene base or a mixed paraffin-naphthene base distillate or residual oil. The mineral oil or other lubricanting oil which comprises the major portion of the lubricant composition can also be subjected to other refining procedures prior to use such as solvent refining, and solvent dewaxing. A preferred lubricanting oil for use in the lubricant composition of the present invention can have a SUS viscosity at 100° F. between about 50 and 1000. Generally the viscosity range falls between 70 and 300 at 100° F. Synthetic lubricating oil bases are well known in the art and can also be used in the lubricant composition whether as the only lubricating oil component, a major portion thereof or minor portion of such a lubricant composition. Synthetic lubricating oil bases include synthetic esters and synthetic ethers.

The following examples are given to illustrate the lubricant composition of the present invention and the synergistic effect of the combination of detergents and/or dispersant additives.

EXAMPLE I

A base multiviscosity lubricatant composition was blended. The composition of the base lubricant did not contain a dispersant and/or detergent. This base lubricant when blended (90% by weight) with dispersant and diluent oil (10% by weight total) was similar to SAE 15 W-40 oil.

To the base lubricant composition was added a sufficient quantity of a succinimide so that the contribution of nitrogen from the succinimide was about 0.07 percent by weight of the lubricant composition. This succinimide was about 7.6 percent by weight of a N-hydroxyacylated polyamine succinimide, more specifically the reaction product in the ratio of about 1 mole of polybutenyl succinic acid anhydride to about 0.65 mole of tetraethylpentamine, followed by treatment with about 1.95 mole of glycolic acid. The tetraethylpentamine was made by reacting amonmia and dichloroethylene and distilling out the desired fraction. Also added to the lubricatant composition was about 1% by weight of the polyisobutenyl thiophosphonatester of pentaerythritol which was made as previously described.

The lubricant composition was tested in a Bench VD test. This test measured the dispersency of the additive in a lubricant composition. In the test, both a sample of the lubricant composition to be tested and a reference sample of a known lubricant composition were heated to a temperature of about 145° C. Both samples were then artificially degraded by bubbling air through them at a rate of about 960 milliliters per minute. Further, every hour synthetic blowby was added to both samples. The synthetic blowby was a degraded fuel which is similar in properties to the actual blowby produced by internal combustion engines. At the end of six hours samples were removed and diluted with oil. Their turbitity was then measured using a turbitimeter.

The standard lubricant composition was used to adjust the meter to a standard reference reading of about 55. The turbidity of the lubricant composition under test was then measured. Lubricant compositions having turbidity readings between 50 and 70 are considered borderline, lubricant compositions registering 70 or greater fail the test. A useful SF quality lubricant oil should read 60 or less. When the lubricant composition of the present invention containing the two dispersants and/or detergent additives was tested, the result was about 50 which showed that the mixture of the two additives produced a very useful lubricant composition.

EXAMPLE II

To the base lubricant of Example I was added about 6.5% by weight of the same N-hydroxyacylated polyamine succinimide used in Example I which was in an amount so that the contribution of nitrogen from the succinimide was about 0.06 percent by weight of the lubricant composition and also about 2% by weight of the polyisobutenyl thiophosphonate ester of pentaerythritol of Example I. When this composition was subjected to the bench VD test, the results of one run was 72, and the results of a second run was 64. These results showed that this concentration of additives produced a higher turbidity, thus this ratio of additives was less successful in the lubricating composition than that of Example I.

EXAMPLE III

To the base lubricant composition of Example I was added about 5.5% by weight of the N-hydroxacylated polyamine succinimide of Example I which was in an amount so that the contribution of nitrogen from the succinimide was about 0.05 percent by weight of the lubricant composition and about 3 percent by weight of the polyisobutenyl thiophosphonate ester of Example I. The bench VD test gave a result of about 80 which showed that this level of additive, where less of the succinimide and more of the ester was used, produced a poorer result then of Example I.

The results of Examples I to III show that a certain ratio of succinimide to ester of between about 15:1 and 3:1, produces the most desired results, however a wider ratio of between about 100:1 and 0.05:1 is also useful. The examples also show that relatively small quantities of both additives are necessary. The results of elastomer, specifically Viton AK-6, compatibility tests are set forth in U.S. Pat. No. 4,482,464. These tests show good compatibility between the succinimide and the elastomer. The ester is also expected to have good compatibility since it does not contain nitrogen. Since both additives are expected to be compatible to the Viton AK-6 elastomer, the lubricant composition containing the mixture of both additives is also expected to be compatible with the Viton AK-6 elastomer.

EXAMPLE IV (COMPARATIVE)

To the base lubricant composition of Example I, was added about 8.7% by weight of the succinimide of Example I which was in an amount so that the contribution of nitrogen from the succinimide was about 0.08 percent by weight of the lubricant composition. When this lubricant composition was tested in the bench VD test, the turbidity was measured at 109 which is much higher than the turbidity results of Example I–III wherein both the succinimide and the ester were used in the lubricant composition. This shows that this concentration of the succinimide, by itself, is not as useful as the combination of the ester and succinimide under similar test conditions.

EXAMPLE V (COMPARATIVE)

To the base lubricant composition of Example I was added about 8% by weight of the polyisobutenyl thiophosphonate ester of Example I. When this lubricant composition was subjected to the bench VD test of Example I, the turbidity was measured as 79. This again shows that the use of a single dispersant at a given concentration, here the alkythiophosphonate ester was not as useful as the mixture of the succinimide and the polyisobutenyl thiophosphonate ester of Examples I to III.

EXAMPLE VI

To the base lubricant composition set forth in Example I was added about 6.6% by weight of an N-hydroxyacylated polyamine succinimide which was in an amount so that the contribution of nitrogen from the succinimide was about 0.08 percent by weight of the lubricant composition which was made by reacting in the ratio of about one mole of polybutenylsuccinic acid anhydride to about 0.9 mole of tetraethylpentamine, followed by treatment with about 3.4 mole of glycolic acid. The bench VD test performed on this lubricant composition producted a result of about 155, which is far worse than produced by the lubricant composition containing the mixture of both the succinimide and the ester.

EXAMPLE VII

To the base lubricant composition set forth in Example I was added about 4.9% by weight of the succinimide of Example VI which was in amount so that the contribution of nitrogen from the succinimide was about 0.06 percent by weight of the lubricant composition, and also added was about 2% by weight of the polyisobutenyl thiophosphonate ester of Example I. The lubricant composition containing these two additives was then subjected to the bench VD test with a result of about 71. Even though this is a marginal result, this is still better than that achieved with the use of 8% by weight of the polyisobutenyl thiophosphonate ester by itself and much better than that achieved through the use of the polybutenyl succinimide of Example VI at a higher concentration of about 6.6% by weight.

EXAMPLE VIII

To the base lubricant composition of Example I, was added about 1% by weight of the ester of Example I and about 8.9% by weight of a succinimide which was in an amount so that the contribution of nitrogen from the succinimide was about 0.07 percent by weight of the lubricant composition which succinimide was made by reacting in the ratio of about one mole of polybutenylsuccinic acid anhydride to about 0.55 mole of tetraethylpentamine, followed by treatment with about 1.5 mole of glycolic acid. Upon performing the bench VD test on the lubricant composition, the result was found to be about 54. Such a result shows that this lubricant composition is quite useful and contains a useful dispersant and/or detergent combination. Compare this result to the results of Example V wherein the ester was used alone and to Example IV or VI wherein succinimides were used alone. Such a comparison shows that the combination of the ester and the succinimide of the present invention produces a much better result than the use of either the succinimide or ester alone.

EXAMPLE IX

To the base lubricant composition of Example I was added about 7.6% by weight of the succinimide which was in an amount so that the contribution of nitrogen from the succinimide was about 0.06 percent by weight of the lubricant composition which succinimide was made as in Example VIII and also added was about 2% by weight of the ester of Example I. The bench VD result was 49 which shows that such a mixture of additives also produces an acceptable lubricant composition.

EXAMPLES X–XIV

N-Hydroxyacylated polyamine succinimides are made by reacting in the ratio of about one mole of polybutenylsuccinic acid anhydride to about 0.9, 0.8, 0.65 and 0.55 mole, respectively, of pentaethylenehexamine, followed by treatment with about 3.6, 3.1, 2.3, and 1.7 mole respectively, of glycolic acid. The pentaethylenehexamine is made by reacting ethylene dichloride with ammonia and then distilling the desired fraction.

To the lubricant composition of Example I is added from about 4 to 10 by weight of the succinimide of the previous paragraph along with about 1% by weight of the ester of Example I.

The examples show that an additive including both the thiophosphonate ester and the succinimide of the invention produce a lubricant composition which scores very well on the bench VD test and thus indicates that such a lubricant composition would be useful in an internal combustion engine. Comparing the examples wherein the succinimide or ester is used by itself with the examples wherein the combination of additives is used, it can be seen that the single additive produces results far inferior to that of the combination of the two additives. Since the bench VD test measures the dispersant effect of an additive on an oil undergoing oxidation, it can be seen that such a dispersant combination of the ester and succinimide produces a lubricant composition which can contain oils having a high oxidation problem.

The above examples are for illustrative purposes only and variations can be made by those skilled in the art without going outside of the scope of the invention set forth in the following claims.

What is claimed is:

1. A lubricant composition comprising a major amount of a lubrication oil from about 0.06 to 0.07 weight percent based on nitrogen of a hydrocarbyl-substituted mono- and bis-succinimide having polyamine chain linked hydroxyacyl radicals represented by the formula:

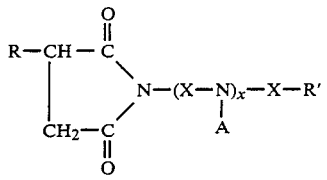

in which R is a hydrocarbyl radical having from about 8 to 400 carbon atoms, X is a divalent alkylene or secondary hydroxy substituted alkylene radical having from 2 to 3 carbon atoms, A is hydrogen or a hydroxyacyl radical selected from the group consisting of glycolyl, lactyl, 2-hydroxy-methyl propionyl and 2,2'-bis-hydroxymethyl propionyl radicals and in which at least 30 percent of said radicals represented by A are said hydroxyacyl radicals, x is a number from 1 to 6, and R' is a radical selected from the group consisting of —$NH_2$, —NHA, or a hydrocarbyl substituted succinyl radical having the formula:

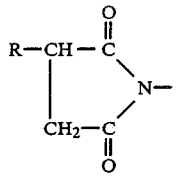

in which R has the values noted above; and from about 1 to 3 weight percent of a polyol derivative prepared by the method comprising (a) contacting an aliphatic polyolefin of an average molecular weight between about 250 and 50,000 with $P_2S_5$ in the presence of between about 0.1 and 5 wt. percent sulfur at a temperature of between about 100° and 320° C., $P_2S_5$ comprising between about 5 and 40 wt. percent of the reaction mixture, (b) contacting the resultant polyolefin-$P_2S_5$ reaction product with steam at a temperature between about 100° and 260° C. utilizing at least about a mole ratio excess of steam in respect to said polyolefin-$P_2S_5$ reaction product, (c) removing inorganic phosphorus acid from the steam treated polyolefin-$P_2S_5$ reaction product, (d) contacting the inorganic acid free, steam hydrolyzed polyolefin-$P_2S_5$ reaction product with a neopentyl polyol of the formula:

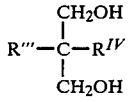

where R''' and $R^{IV}$ are selected from the group consisting of alkylol and alkyl of from 1 to 20 carbon atoms at a temperature between about 180° and 220° C. in a mole ratio of said inorganic phosphorus acid free, steam hydrolyzed $P_2S_5$-polyolefin reaction product to said polyol of between about 1:0.33 and 1:2 to form said polyol derivative.

2. The lubricant composition of claim 1 in which at least 50 percent of said radicals represented by A in said succinimide are hydroxyacyl radicals.

3. The lubricant composition of claim 1 in which substantially all of said radicals represented by A in said succinimide are hydroxyacyl radicals.

4. The lubricant composition of claim 1 in which 50 to 100 percent of said radicals represented by A in said succinimide are glycolyl radicals.

5. The lubricant composition of claim 1 in which at least 70 percent of said radicals represented by A in said succinimide are glycolyl radicals.

6. The lubricant composition of claim 1 in which 50 to 100 percent of said radicals represented by A in said succinimide are lactyl radicals.

7. The lubricant composition of claim 1 in which R is an alkenyl radical having from about 50 to 200 carbon atoms, X is a divalent —$CH_2$—$CH_2$—, or —$CH_2$—CHOH—$CH_2$— radical, A is hydrogen or a glycolyl radical in which 50 to 100 percent of said radicals represented by A is said glycolyl radical, x is a number from 2 to 4, and R' is a radical selected form the group consisting of —$NH_2$ and —NHA in which A has the value noted above.

8. The lubricant composition of claim 1 in which R is an alkenyl radical having from about 50 to 200 carbon atoms, X is a divalent —$CH_2$—$CH_2$—, or a divalent —$CH_2$—CHOH—$CH_2$— radical, A is hydrogen or a glycolyl radical in which at least 70 percent of said radicals represented by A are said glycolyl radical, x is a number from 2 to 4 and R' is a radical selected from the group consisting of —$NH_2$ and —NHA in which A has the value noted above.

9. The lubricant composition of claim 1 in which during the preparation of said polyol derivative the polyolefin-$P_2S_5$ reaction mixture of said "a" step, prior to contact with steam in said "b" step, is diluted with a mineral lubricating oil of an SUS viscosity between about 50 to 1000 to form a diluted polyolefin-$P_2S_5$ reaction mixture having a mineral lubricating oil content of between about 25 and 75 wt. percent and contacting the resultant lubricating oil solution in accordance with said "b", "c" and "d" steps.

10. The lubricant composition of claim 9 in which said polyolefin is polyisobutene said polyol is trimethylol propane.

11. The lubricant composition of claim 9 in which said polyolefin is polyisobutene and said polyol is pentaerythritol.

12. The lubricant composition of claim 9 in which said polyolefin is polyisobutene and said polyol is neopentyl glycol.

13. A concentrate comprising from about 1 to about 80 percent by weight of said succinimide and from about 10 to about 80 percent by weight of said derivative of polyol as set forth in claim 1, with the remainder comprising a lubricating oil.

* * * * *